US011680561B2

(12) United States Patent
Ingebrand et al.

(10) Patent No.: US 11,680,561 B2
(45) Date of Patent: Jun. 20, 2023

(54) MULTI-WELL CHEMICAL INJECTION MANIFOLD AND SYSTEM

(71) Applicant: Graco Minnesota Inc., Minneapolis, MN (US)

(72) Inventors: John R. Ingebrand, New Prague, MN (US); Kyle A. Bottke, Robbinsdale, MN (US); Ryan J. Dion, Circle Pines, MN (US); Kelly L. Shanks, Eagan, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 31 days.

(21) Appl. No.: 17/161,090

(22) Filed: Jan. 28, 2021

(65) Prior Publication Data

US 2021/0230988 A1 Jul. 29, 2021

Related U.S. Application Data

(60) Provisional application No. 62/967,255, filed on Jan. 29, 2020.

(51) Int. Cl.
*F04B 49/06* (2006.01)
*F04B 49/22* (2006.01)

(52) U.S. Cl.
CPC ..... *F04B 49/065* (2013.01); *F04B 49/22* (2013.01)

(58) Field of Classification Search
CPC ..... E21B 43/14; E21B 43/1235; E21B 37/06; F04B 49/065; F04B 49/22; F04B 2203/0201; F04B 2205/09; F04B 7/0076; F04B 17/03; F04B 49/08; F04B 53/16
See application file for complete search history.

(56) References Cited

U.S. PATENT DOCUMENTS 2,815,925 A * 12/1957 Fisher, Jr. ..... E21B 34/12 251/282
10,145,224 B1 * 12/2018 Shenoy ..... H02K 21/14
2006/0081378 A1 * 4/2006 Howard ..... E21B 43/129 166/372
2008/0314367 A1 * 12/2008 Goulette ..... F02D 41/20 123/472
2017/0363088 A1 * 12/2017 Nguyen ..... F04D 15/0088
(Continued)

*Primary Examiner* — Blake Michener
*Assistant Examiner* — Yanick A Akaragwe
(74) *Attorney, Agent, or Firm* — Kinney & Lange, P.A.

(57) ABSTRACT

A fluid handling system suitable for injecting a pressurized fluid from a pump that is driven by a motor into an oilfield network includes a manifold fluidly connected to the pump and a controller. The manifold includes an inlet for receiving the fluid from the pump, a plurality of outlets downstream of and fluidly connected to the inlet, and a plurality of electric valves downstream of and fluidly connected, respectively, to the plurality of outlets, each of the plurality of electric valves being configured to selectively open and close to regulate a flow of the fluid from the plurality of outlets to a plurality of wells fluidly connected, respectively, to the plurality of electric valves. The controller is configured to receive a plurality of flow rate values of the plurality of wells, determine a plurality of duty cycles for the plurality of electric valves based on the plurality of flow rate values, and determine a schedule for the plurality of duty cycles so that only one of the plurality of electric valves is controlled open at a given time.

19 Claims, 8 Drawing Sheets

(56) References Cited

U.S. PATENT DOCUMENTS

| | | | | |
|---|---|---|---|---|
| 2018/0196446 | A1* | 7/2018 | Imel | F16K 37/0083 |
| 2020/0062580 | A1* | 2/2020 | Shock | B67D 7/36 |
| 2020/0392802 | A1* | 12/2020 | Quero | E21B 43/16 |
| 2021/0115779 | A1* | 4/2021 | Hopwood | E21B 21/08 |

* cited by examiner

MULTI-WELL CHEMICAL INJECTION MANIFOLD AND SYSTEM

CROSS-REFERENCE TO RELATED APPLICATION(S)

This application claims the benefit of U.S. Provisional Application No. 62/967,255 filed Jan. 29, 2020 for "MULTI-WELL CHEMICAL INJECTION MANIFOLD AND SYSTEM" by J. Ingebrand, K. Bottke, R. Dion, and K. Shanks.

BACKGROUND

The present invention relates to chemical injection pumps, and more specifically, injection pumps associated with fluid handling systems having multiple well bores.

Chemical injection pumps are used to dispense chemicals into piping extending through, or otherwise associated with, oil wells or other type of organic fuel extraction wells. The chemicals can resist corrosion, inhibit particulate formation, and keep passages and valves clean for efficient and uncontaminated extraction. Typically, multiple well bores are located on one site, each requiring chemical injection. Instead of providing a chemical injection system for each bore, a single chemical injection system can support the injection of chemical into the piping systems of multiple bores, reducing equipment cost and minimizing maintenance.

SUMMARY

A fluid handling system suitable for injecting a pressurized fluid from a pump that is driven by a motor into an oilfield network includes a manifold fluidly connected to the pump and a controller. The manifold includes an inlet for receiving the fluid from the pump, a plurality of outlets downstream of and fluidly connected to the inlet, and a plurality of electric valves downstream of and fluidly connected, respectively, to the plurality of outlets, each of the plurality of electric valves being configured to selectively open and close to regulate a flow of the fluid from the plurality of outlets to a plurality of wells fluidly connected, respectively, to the plurality of electric valves. The controller is configured to receive a plurality of flow rate values of the plurality of wells, determine a plurality of duty cycles for the plurality of electric valves based on the plurality of flow rate values, and determine a schedule for the plurality of duty cycles so that only one of the plurality of electric valves is controlled open at a given time.

A fluid handling system suitable for injecting a pressurized fluid from a pump that is driven by a motor into an oilfield network includes a manifold fluidly connected to the pump and a controller. The manifold includes an inlet for receiving the fluid from the pump, a plurality of outlets downstream of and fluidly connected to the inlet, and a plurality of electric valves downstream of and fluidly connected, respectively, to the plurality of outlets, each of the plurality of electric valves being configured to selectively open and close to regulate a flow of the fluid from the plurality of outlets to a plurality of wells fluidly connected, respectively, to the plurality of electric valves. The controller is configured to receive a plurality of flow rate values of the plurality of wells, determine a plurality of duty cycles for the plurality of electric valves based on the plurality of flow rate values, determine a schedule for the plurality of duty cycles so that only one of the plurality of electric valves is controlled open at a given time, and detect a failed one of the plurality of electric valves based on an increase of a parameter.

A manifold for use in a fluid handling system suitable for injecting a pressurized fluid from a pump that is driven by a motor into an oilfield network includes a manifold block having an inlet for receiving the fluid from the pump, a plurality of outlets downstream of and fluidly connected to the inlet, and a plurality of electric valves downstream of and fluidly connected, respectively, to the plurality of outlets.

DETAILED DESCRIPTION

Figure 1:
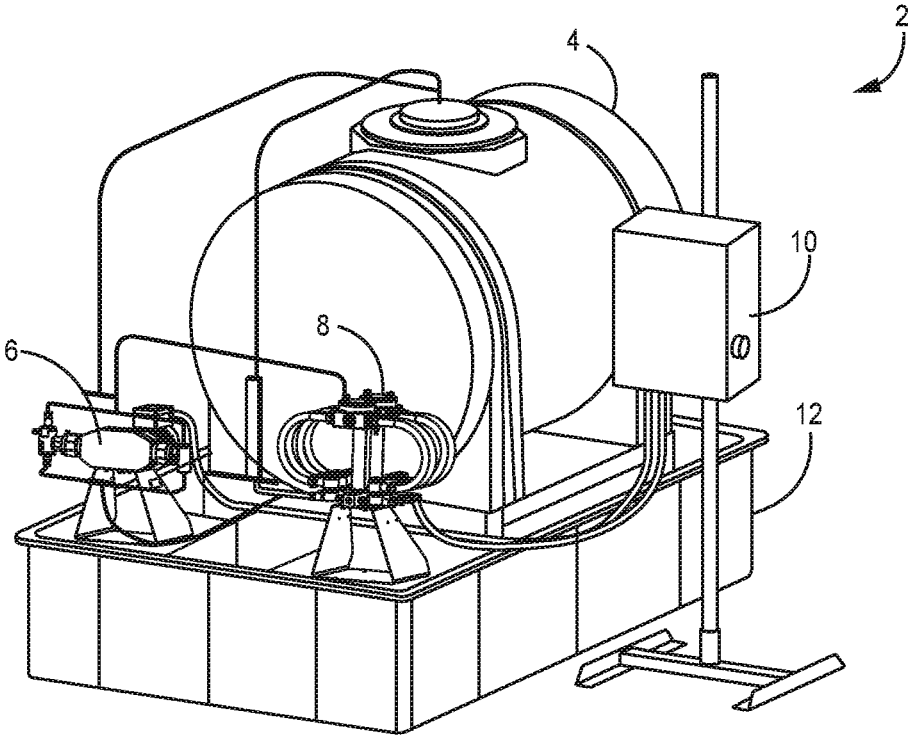
FIG. 1 is a perspective view of a well injection pump system.

FIG. 1 is a perspective view of well injection pump system 2. As shown, system 2 includes reservoir 4, pump 6, manifold 8, controller 10, and capture tank 12. Reservoir 4 can be a tank which holds a chemical solution to be introduced into the piping of a wellbore, and more specifically, into piping associated with an oil well (not shown in FIG. 1). Pump 6 is in fluid communication with reservoir 4 for receiving the chemical solution from reservoir 4 and pumping the solution under pressure out of pump 6 to manifold 8. Pump 6 can be a dual piston pump in an exemplary embodiment, but in an alternative embodiment, can be a single piston pump or other suitable pump. Manifold 8 is in fluid communication with pump 6 via a supply line through which it receives the chemical solution from pump 6. Manifold 8 can also include multiple output lines for injecting the chemical solution into associated wellbores, as is discussed in greater detail below.

Controller 10 can be operatively connected, either communicatively or electrically with each of pump 6 and manifold 8 for controlling operation of pump 6 and manifold 8. Accordingly, controller 10 can include control circuitry, such as one or more microprocessors or other logic circuitry with associated memory, for carrying out the functions referenced herein. Controller 10 can provide a command signal to pump 6 to provide proportionate power or otherwise instruct pump 6, including when to start/stop pumping and at what speed (in the case of a variable speed pump), amongst other possible commands. In some, but not all, embodiments, controller 10 can also supply electrical power to pump 6. Controller 10 can provide one or more command signals to manifold 8 instructing which of the plurality of output lines to route the chemical solution to the wellbores. Such command signals can include timing (i.e., when and for how long) of injections of the chemical solution through specified output lines corresponding to the desired rate of supply of chemical solution to each wellbore.

Capture tank 12 supports reservoir 4, pump 6, and manifold 8. Capture tank 12 is disposed to capture any and all fluids (e.g., chemical solution) that might leak from well injection pump system 2 to prevent ground contamination. The inclusion of capture tank 12 limits the available footprint of reservoir 4, pump 6, and manifold 8, as they must remain within the bounds of capture tank 12 to enable capture tank 12 to collect any leaking fluids.

Figure 2:
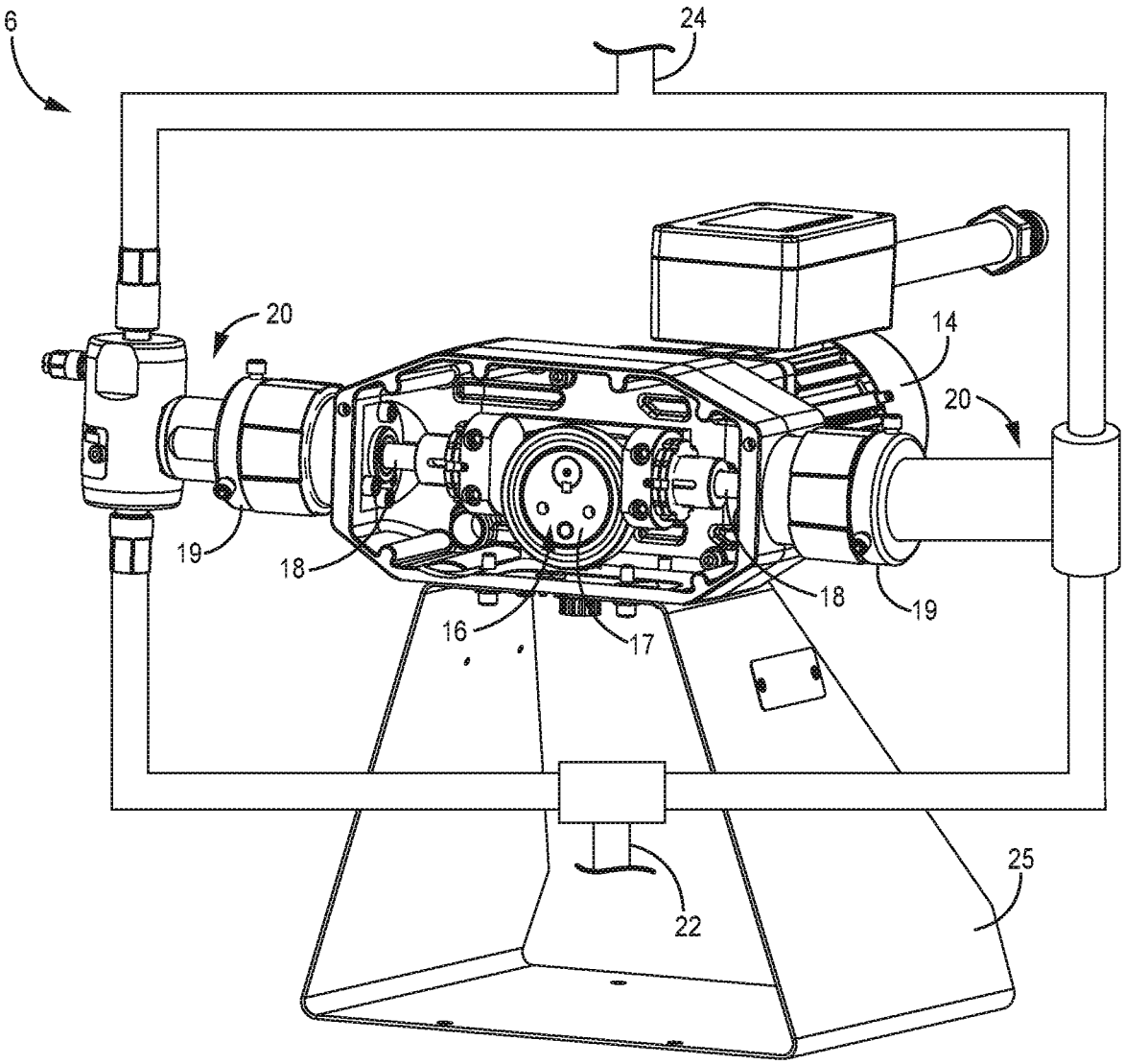
FIG. 2 is a detailed view of a pump belonging to the system of FIG. 1 with a portion of the outer cover removed to show internal components.

FIG. 2 is a detailed view of pump 6 with a portion of the outer cover removed to show various internal components. Associated fluid lines are represented schematically. Pump 6 includes motor 14, drive 16, pistons 18, housings 20, inlet 22, and outlet 24. Pump 6 is mountable to capture tank 12 (shown in FIG. 1) via base 25 which elevates pump 6 vertically above capture tank 12. In the embodiment of FIG. 2, motor 14 is an electric motor having a rotor and stator, however other types of motors can be used. Motor 14 outputs rotational motion to drive 16. Drive 16 is configured to convert the rotational motion from motor 14 to linear reciprocating motion to linearly reciprocate pistons 18. In the embodiment shown, drive 16 includes cam 17 that linearly reciprocates pistons 18.

Pistons 18 reciprocate within pump housings 20, and more specifically, within cylinders 19, to pump the chemical solution received from reservoir 4 under pressure. As shown in FIG. 2, pump 6 is a dual sided pump having a piston 18 on each of its lateral sides, however various other configurations, including a single piston or other types of pumping mechanisms are contemplated herein. In the embodiment shown, each piston 18 reciprocates on the same reciprocation axis, although it should be understood that not all embodiments are configured as such. Pump 6 receives the chemical solution from reservoir 4 via inlet 22, and outputs the chemical solution under pressure through outlet 24, which is in fluid communication with manifold 8. Pump 6 can output the chemical solution under pressures of over 1000 PSI (6894.8 kPa), and further over 2000 PSI (13789.5 kPa). Pump 6 can generally output solution between 1000-6000 PSI (6894.8-41368.5 kPa) among other possible ranges.

Figure 3:
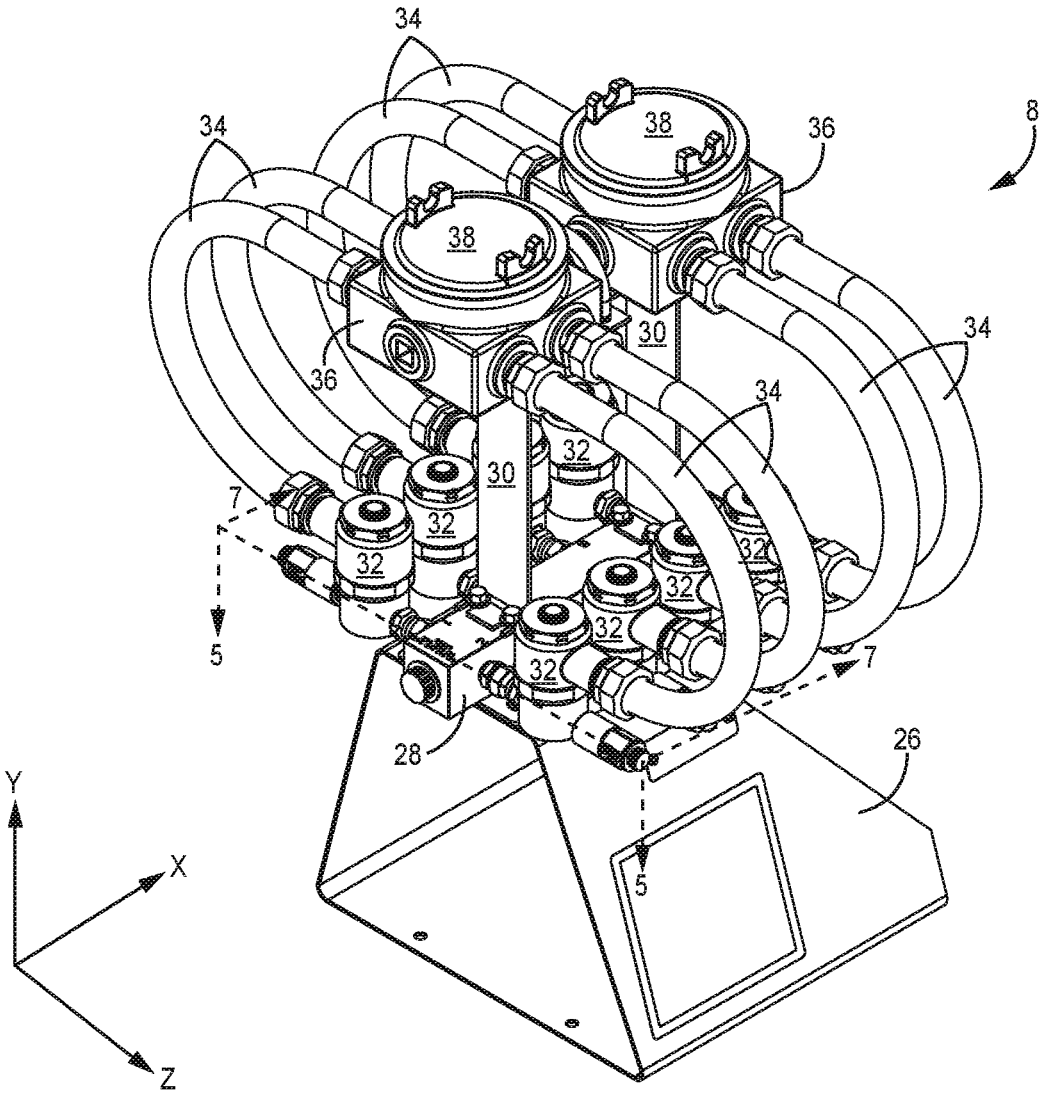
FIG. 3 is a detailed perspective view of manifold belonging to the system of FIG. 1.

FIG. 3 is a detailed perspective view of manifold 8. As shown in FIG. 3, the y-axis indicates the vertical direction, the z-axis indicates the lateral direction, and the x-axis indicates the longitudinal direction. Like pump 6, manifold 8 is supported by and mountable to capture tank 12 via base 26. Base 26 elevates manifold 8 vertically above capture tank 12 and the surface upon which capture tank 12 is disposed, such as the ground surface. Manifold 8 is supported vertically above the maximum fluid level in capture tank 12. Such configuration prevents exposure of manifold 8 to fluids in the event of a rupture of reservoir 4 or leak from another system.

Manifold 8 includes manifold block 28, supports 30, electric valves 32, electrical conduits 34, electrical junction housings 36, and inlet 44 (shown and labeled in FIGS. 5 and 6) for receiving the chemical solution from pump 6. Manifold block 28 can be a metal housing with a plurality of channels therethrough for routing the chemical solution from pump 6 to various associated wells. Electric valves 32 are attached to manifold block 28. Each electric valve 32 is configured to route an amount of the overall flow of chemical solution from manifold block 28. Electric valves 32 can selectively open and close to regulate the flow of the chemical solution from manifold block 28 to respective wells, as managed by controller 10. As discussed herein, an open electric valve 32 permits flow of the chemical solution therethrough, and a closed electric valve 32 does not permit flow of the chemical solution therethrough. Each electric valve 32 can be associated with a different one of the respective wells.

Each support 30 rests on and is attached to manifold block 28 to elevate an electrical junction housing 36. Although two electrical junction housings 36 are shown in FIG. 3, alternative embodiments can include only one electrical junction housing 36, or more than two electrical junction housings 36. Each electrical junction housing 36 houses electrical connections between controller 10 and electric valves 32. Electrical junction housings 36 are sealed by respective doors 38 to prevent the infiltration of fluids and other contaminants.

Electrical conduits 34 are disposed between and connected to electrical junction housings 36 and respective electric valves 32. More specifically, in the embodiment shown in FIG. 3, each electrical junction housing 36 is attached to four electrical conduits 34, with each electrical conduit 34 being connected to a single electric valve 32. Electrical conduits 34 and the associated fittings to electrical junction housings 36 and electric valves 32, are sealed to prevent fluid infiltration to maintain the integrity of internal electrical connections between electrical junction housings 36 and electric valves 32. Each electrical conduit 34 can be polymer (e.g., rubber) tubing, among other options. Such tubing may further include a metal wire or ribbon braiding for strength. A separate electrical conduit 34 is provided for each electric valve 32 so that each electric valve 32 can be serviced and/or replaced without exposing, disassembling, or otherwise disturbing the other electric valves 32.

As can be seen in FIG. 3, manifold 8 is arranged such that electrical junction housings 36 are positioned directly above (over, on top of, etc.) manifold block 8, relative to the y-axis (i.e., vertical direction). Electrical conduits 34 extend downward from electrical junction housings 36 to respective electric valves 32. Such arrangement advantageously protects electrical junction housings 36 from fluid leaks within manifold block 28 and/or associated inlets, outlets, and fluid handling components, because gravity would cause fluid to flow, drip, and/or pour out in the downward direction and away from electrical junction housings 36.

Figure 4:
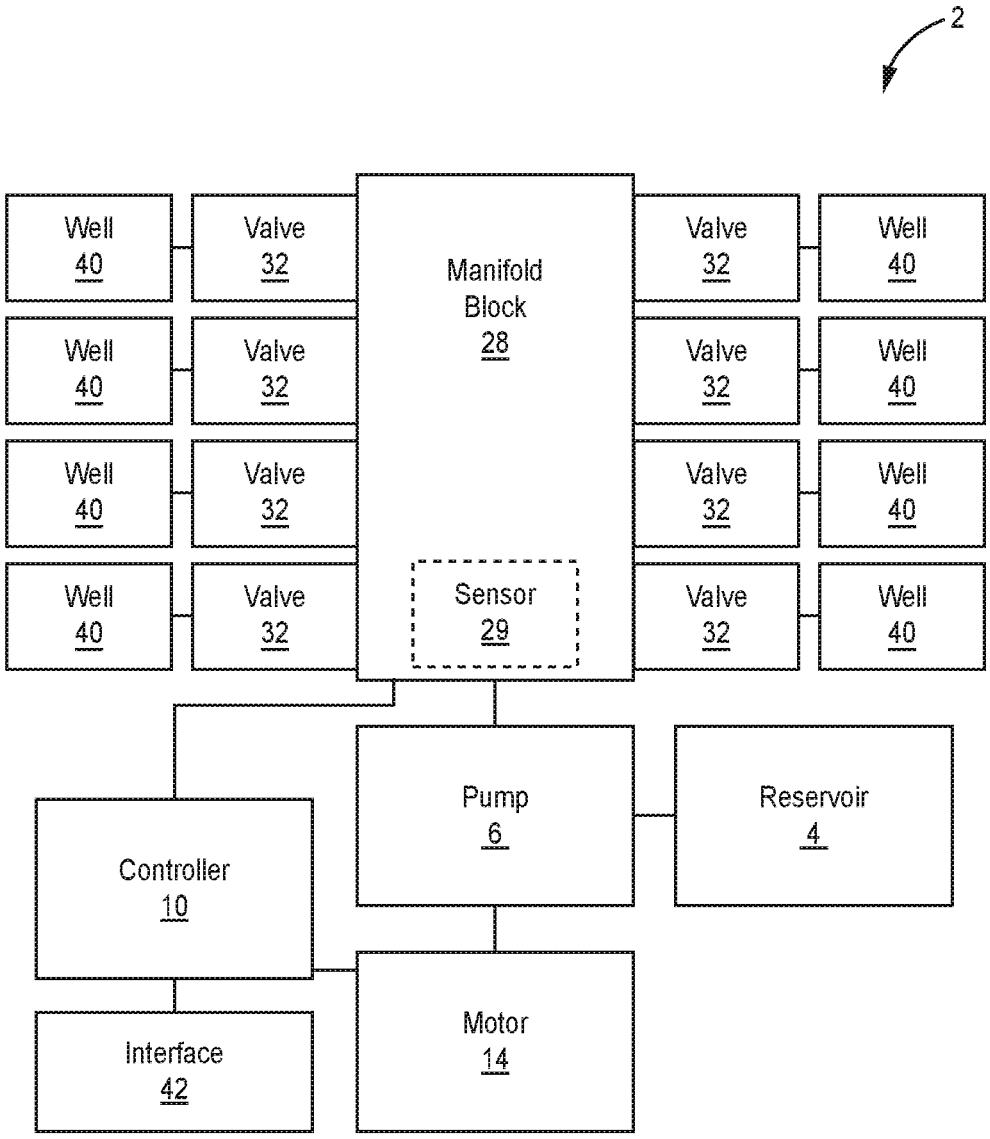
FIG. 4 schematically illustrates the system of FIG. 1.

FIG. 4 is a schematic illustration of well injection pump system 2. As shown, each electric valve 32 is in fluid communication with a well 40 and regulates flow of the chemical solution from manifold block 28 to the well 40 associated with that electric valve 32. More specifically, in the embodiment of FIG. 4, eight electric valves 32 are in fluid communication with eight respective wells 40. As such, a single electric valve 32 regulates the flow of the chemical solution to a single well 40 as output by manifold block 28. It will be understood that a greater or lesser number of wells 40 can be serviced, in which case the same number of electric valves 32 may be used. An electric valve 32 can also remain in a closed position when not connected to a well 40, or an electric valve 32 can alternatively be disconnected and replaced with a plug such that it does not fluidly interconnect manifold block 28 with a well 40. In various other embodiments, manifold block 28 can be configured to support fewer than eight electric valves 32 and wells 40, for example, manifold block 28 can be configured to support six electric valves 32 and respective wells 40. Alternatively, manifold block 28 can be configured to support at least three electric valves 32 and respective wells 40. Optional pressure sensor 29 is also shown downstream of pump 6 and is discussed in greater detail below.

Also shown in FIG. 4 is interface 42 of controller 10. Interface 42 can be physically co-located with controller 10 (as shown mounted in FIG. 1), or it can be located elsewhere and/or portable. Interface 42 can include an input/output device such as a keypad, touchscreen, or dial, and further can include one or more screens for displaying information. Interface 42 can be a remote computing device such as a smart phone, tablet, a laptop computer, or another type of computing device. Interface 42 can communicate with controller 10 via a wired or wireless connection. Controller 10 can include one or more processors, such as a microprocessor, and separate or integrated memory for storing program instructions executable by the processor for performing the functions referenced herein. Controller 10 can further include circuitry for receiving, conditioning, and distributing power to any of the various electronic components referenced herein. Controller 10 can be electrically connected, or wirelessly connected, to any of the electrical components referenced herein for issuing commands for, or otherwise controlling, the operation of the electrical components.

Figure 5:
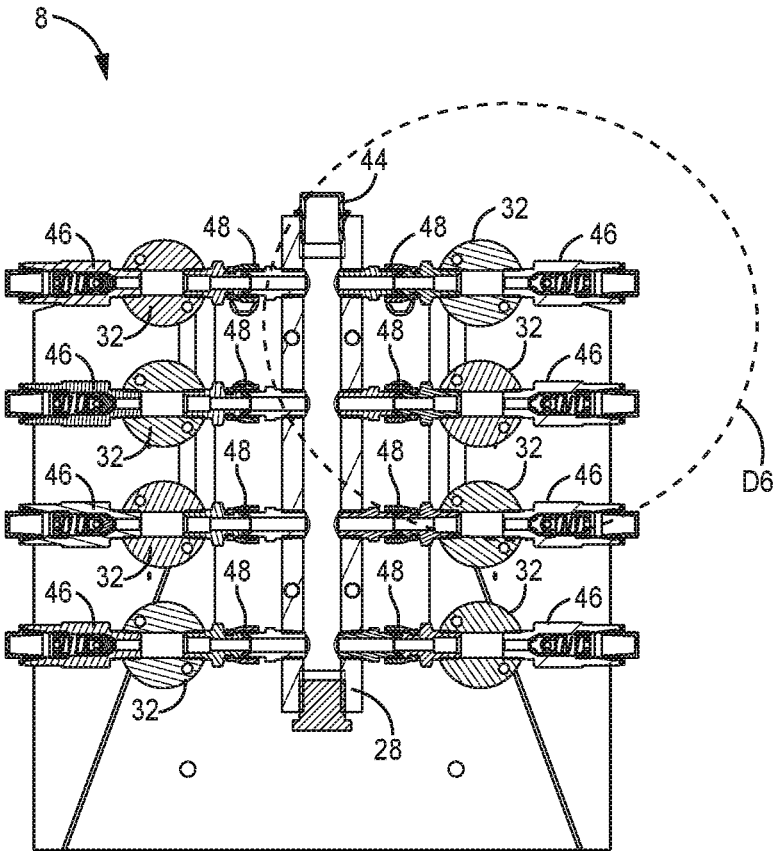
FIG. 5 is a cross-sectional view of the manifold taken along line 5-5 of FIG. 3.
Figure 6:
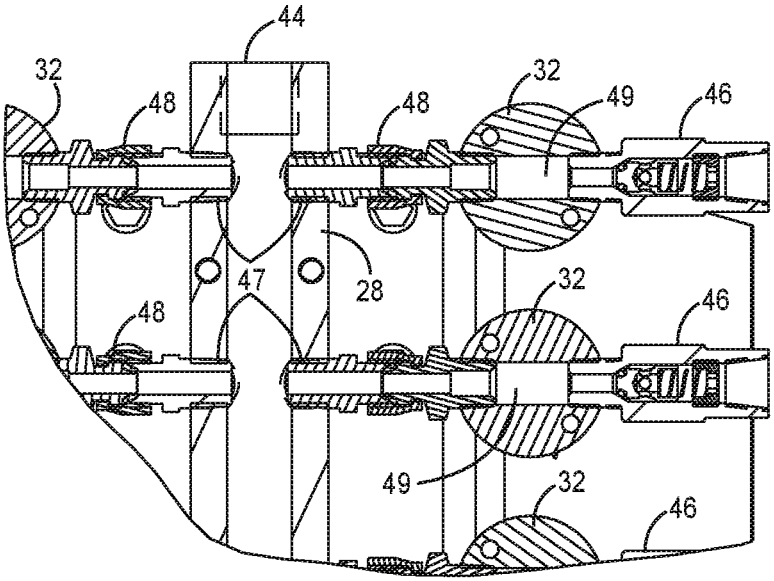
FIG. 6 is a close-up view of detail D6 of FIG. 5.

FIG. 5 is a cross-sectional view of manifold 8, taken along line 5-5 shown in FIG. 3. FIG. 6 shows detail D6 of FIG. 5. FIGS. 5 and 6 will be discussed together. As shown, manifold 8 is configured as a central channel (i.e., manifold block 28) in fluid communication with eight branches fluidly connecting manifold 28 with eight electric valves 32. Inlet 44 fluidly connects manifold block 28 with pump 6 (schematically shown in FIG. 4). Eight connectors 48 fluidly connect outlets 47 (labeled in FIG. 6) of manifold block 28 with eight electric valves 32. As such, connectors 48 are upstream of electric valves 32, based on the direction of fluid flow. Connectors 48 can be one or a combination of swivel connectors, threaded connectors, or quick disconnect type connectors. Connectors 48 can disengage electric valves 32 from manifold block 28 for replacement or other servicing.

Each electric valve 32 can permit or block fluid flow from a respective upstream outlet 47 and connector 48 to a respective downstream check valve 46. Each electric valve 32 includes fluid channel 49 through which fluid can flow in an open state of electric valve 32. Each check valve 46 is a one-way valve that allows downstream flow while preventing upstream flow. For example, each check valve 46 can be a ball and spring type valve which permits only unidirectional fluid flow. More specifically, each check valve 46 may only permit fluid flow away from a respective electric valve 32 toward a respective well 40. This configuration prevents backflow to electric valves 32 such that the chemical solution pumped out of manifold block 28 and past electric valve 32 does not return back to manifold block 28. Each check valve 46 can also restrict fluid flow from the upstream direction by requiring a threshold amount of pressure differential between the upstream side of check valve 46 (e.g., the output of electric valve 32) and the downstream side of check valve 46 before check valve 46 opens to permit fluid flow from the upstream direction (i.e. from electric valve 32) through check valve 46 toward well 40. The threshold differential pressure can be set based on, for example, spring tension within check valve 46. For example, the threshold pressure differential can be about 10 PSI (68.9 kPa).

Figure 7:
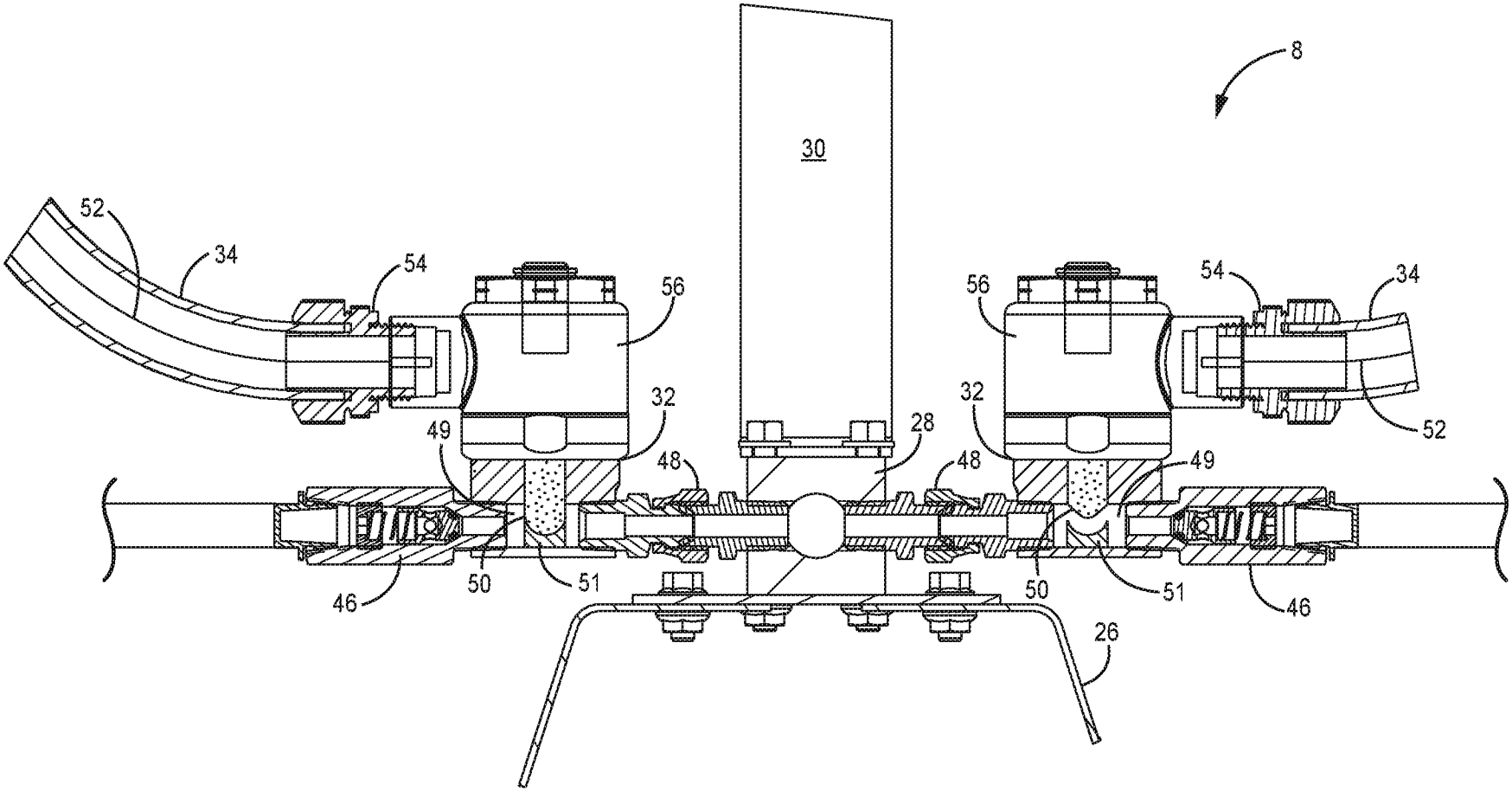
FIG. 7 is a partial cross-sectional view of the manifold taken along line 7-7 of FIG. 3.

FIG. 7 is a partial cross-sectional view of manifold 8 taken along line 7-7 shown in FIG. 3. FIG. 7 shows electric valves 32 in greater detail. Each electric valve 32 includes an electronic actuator 56 which can, in an exemplary embodiment, be a solenoid. However, other types of electronic actuators are contemplated herein. Electronic actuator 56 receives a signal (e.g., electronic power or other type of signal) from controller 10 via cord 52. Cord 52 extends through electrical conduit 34 from electrical junction housing 36. Cord 52 operatively (e.g., electrically and/or communicatively) connects electric valve 32 to controller 10. An electric signal provided to electric valve 32 via cord 52 can cause electronic actuator 56 to open a respective electric valve 32 to permit fluid flow from the respective connector 48 of the electric valve 32 to the respective check valve 46 of the electric valve 32. Electric valves 32 are normally closed valves that are actuated to the open state. In a nominal unpowered state, electronic actuator 56 keeps electric valve 32 closed to prevent fluid flow from the connector 48 to the check valve 46. Only when electronic actuator 56 is activated to open does electric valve 32 permit fluid flow from connector 48 to check valve 46. For example, electronic actuator 56 can include a spring to bias electronic actuator 56, and thus electric valve 32, towards the closed state. As a solenoid, electronic actuator 56 can include one or more coils that, when electrified, cause movement of a shuttle, overcoming the spring force that otherwise keeps electric valve 32 closed. As shown in FIG. 7, electric valve 32 includes piston 50 which can be lowered to contact seat 51 (as shown on the left side FIG. 7) which forms a seal to prevent fluid flow across fluid channel 49. Piston 50 can be raised to permit fluid flow (as shown on the right side of FIG. 7) corresponding to electrical activation of electric actuator 56 lifting piston 50 permit fluid flow.

As shown in FIG. 7, the various electronic components of/associated with electric valve 32 (e.g., actuator 56, cord 52, etc.) are situated above the fluid handling portion of electric valve 32 (i.e., fluid channel 49) and associated fluid handling components (e.g., connector 48 and check valve 46) of manifold 8, with respect to the vertical direction as indicated by the y-axis (FIG. 3). Advantageously, any fluid leaking from within manifold 8 should not come into contact with the electronic components, as gravity will tend to cause leaking fluid to flow, drip, and/or pour downward from the fluid handling components and away from the electronic components.

In various embodiments, electric valves 32 do not provide any feedback or communication to controller 10, nor are the positions of pistons 50 directly monitored. Rather, as further explained herein, proper operation of each electric valve 32 is assumed, as power is sent to each electric valve 32, and faulty operation of an electric valve 32 can be detected by an indirect parameter, such as motor 14 current and/or fluid pressure downstream of pump 6 but upstream of the electric valve 32, as is discussed in greater detail below.

Also shown in FIG. 7 are connectors 54 of electrical conduits 34 for connecting electrical conduits 34 to electric valves 32. More specifically, each connector 54 connects to a respective electronic actuator 56 of electric valve 32. Connectors 54 allow for a sealed electrical connection between cord 52 and electronic actuator 56. In an exemplary embodiment, connector 54 can threadedly connect electrical conduit 54 and electric valve 32, but it should be understood that other connection types are possible. Connector 54 allows for detachment of electrical conduit 34 from electronic actuator 56 of electric valve 32, such as, for example, during replacement of electric valve 32 and/or electronic actuator 56. Electronic actuator 56 can be replaced by its disconnection from a respective electric valve 32, as well as from connector 54, while the lower section, including the seal 50, remains intact. As such, electronic actuator 56 can be replaced for a respective electric valve 32 without disturbing the fluid handling components.

Figure 8:
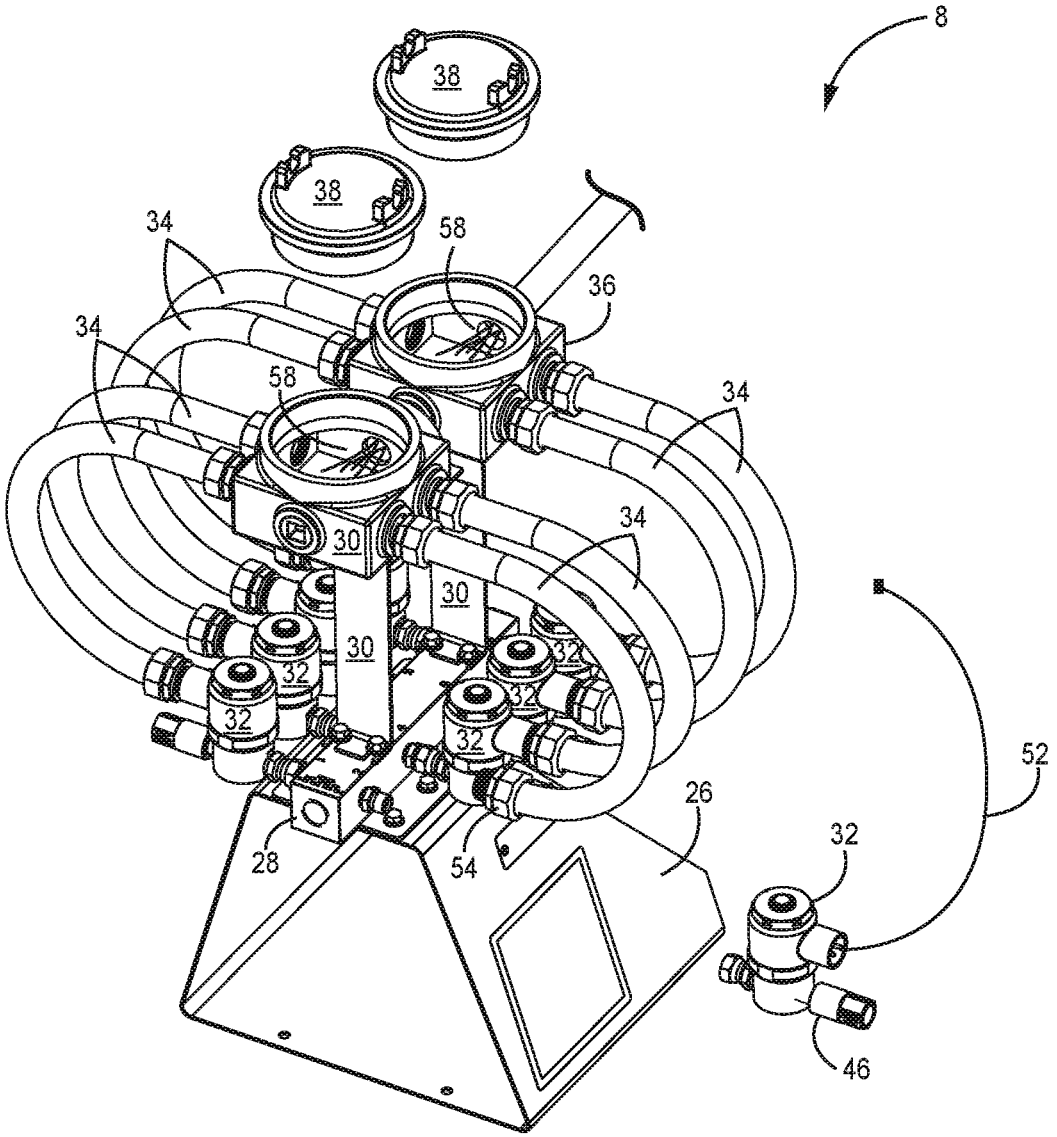
FIG. 8 is a perspective view of the manifold showing one electric valve removed.

FIG. 8 is a perspective view of manifold 8 showing the accessible and modular nature of manifold 8 as one electric valve 32 is removed. Doors 38 of electrical junction housings 36 are also removed to reveal internal components of electrical junction housings 36. Electric valve 32 can be decoupled from manifold block 28 by disengaging connector 48. Electric valve 32 can be decoupled from electrical conduit 34 by disengaging connector 54. Door 38 from the associated electrical junction housing 36 can be opened (e.g., unthreaded or otherwise removed) to expose electrical connections between controller 10 and the electric valve 32 being removed from manifold 8. Such electrical connections can include terminal blocks for connecting cords 58 to respective cables 52. Cords 58 are wired connections from controller 10 to manifold 8. In some examples, cable 52 can be associated with electric valve 32 such that cable 52 is removed from manifold 8 with electric valve 32. As shown, a cable 52 associated with a removed electric valve 32 is visible. The electrical connection can be decoupled within electrical junction housing 36 by disconnecting cable 52 from cords 58. Cable 52 can then be pulled from electrical junction housing 36 through electrical conduit 34 and out from electrical conduit 34 as shown in FIG. 8. A new (i.e., replacement/different) electric valve 32 can then be introduced, extending cable 52 up through electrical conduit 34 back into electrical junction housing 36 to be connected with the respective cords 58. Alternatively, cable 52 can remain disposed within electrical conduit 34 and connected to one or more cords 58 during replacement of electric valve 32. In such an embodiment, cable 52 is disconnected from the removed electric valve 32 and can connect with the new/replacement electric valve 32 at the lower end of electrical conduit 34. In either case, new electric valve 32 is fluidly connected to manifold block 28 via connector 48 and to well 40 via check valve 46.

The easy servicing and replacement of electric valves 32 is facilitated by the fact that electric valves 32 are not located within a housing, which makes them more easily accessible. There are further only three connection/disconnection points per electric valve 32 (at connector 48 on the upstream end, at the downstream end of check valve 46, and the electrical connection via electrical conduit 34 to electrical junction box 36). As such, manifold block 28 does not need to be opened or otherwise exposed. Electrical connection between cords 58 and cable 52 can be disengaged and reengaged via removal of door 38 from electrical junction housing 36 to expose cords 58. A single electric valve 32 can therefore be removed and replaced without disengaging any fluid handling or electrical components of other electric valves 32.

Figure 9:
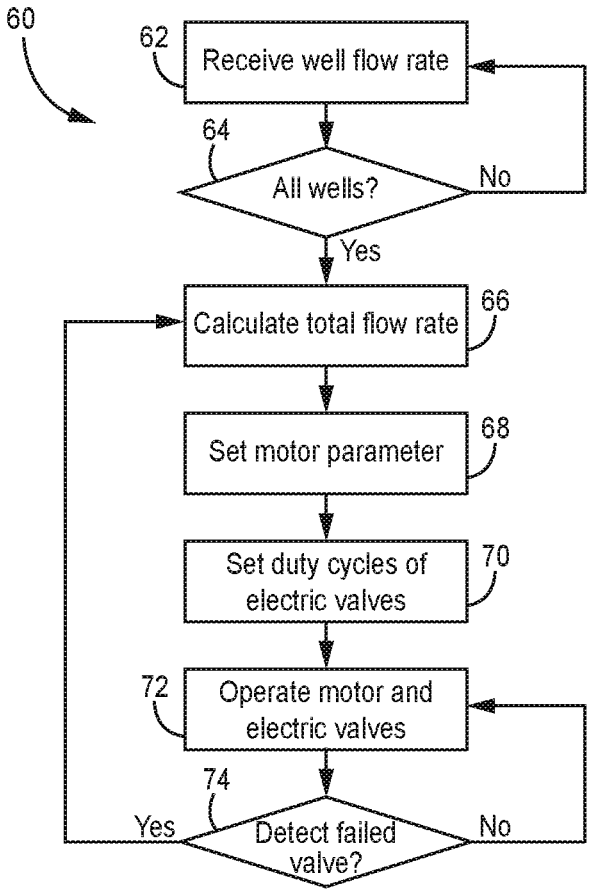
FIG. 9 is a flow chart illustrating a method for operating the well injection pump system.

FIG. 9 is a flowchart illustrating the steps of method 60 for operating well injection pump system 2 (FIG. 1). More specifically, method 60 includes the setting of duty cycles of motor 14 (FIG. 2) of pump 6 (best seen in FIG. 2) and/or of electric valves 32 (best seen in FIGS. 5-8) depending on the type of motor 14. Method 60 also includes failure detection of electric valves 32. It should be understood that in various embodiments, the setting of duty cycles and failure detection can be separately implemented.

Well flow rate information is received at step 62. This can include receiving inputs at controller 10 (FIG. 4) via interface 42 (FIG. 4). Typically, a user (e.g., technician) enters a flow rate for each well 40 (FIG. 4) associated with system 2, which in an exemplary embodiment, is eight wells 40. As discussed herein, flow rate can refer to volume per unit time, such as gallons of chemical solution per day (i.e., per 24-hour period). In some cases, the flow rate for each respective well 40 will be the same, but in other cases, one or more wells 40 can have different flow rates relative to the other wells 40. For example, a well 40 that is extracting more oil may require a higher volume of injected chemical solution relative to the other wells 40 extracting less oil.

Step 64 is a check to determine if flow rate information has been received for all wells 40. This can include a user query on interface 42 to determine if a flow rate has been input for each well 40, or if any additional inputs remain. In some embodiments, the entry of flow rates for all wells 40 is the only parameter entered by the user when setting up and subsequently running system 2. Method 60 returns to step 62 if additional flow rate information is needed, but advances to step 66 if all flow rate data has been input.

Total flow rate (or master flow rate) is calculated at step 66. In one embodiment, controller 10 can aggregate all previously-input flow rate values from step 62. For example, if a flow rate of two gallons per day was input for each of the eight wells 40, then the total flow rate is 16 gallons per day.

A motor parameter is set at step 68. The motor parameter can be set manually by the user, and can further be set based on a characteristic of motor 14 (e.g., speed of motor 14 if motor 14 is a fixed (i.e., single) speed motor, or range of variable speeds if motor 14 is a variable speed motor). The motor parameter can alternatively be set by controller 10 based on the total flow rate calculated at step 66. Accordingly, as a preliminary matter, the configuration of motor 14 as fixed speed or variable speed can be determined, for example, by a query from controller 10 to motor 14, or from information received by controller 10 from motor 14 at startup or when first connected. Such information may also indicate the specific fixed speed or range of variable speeds. This information can alternatively be communicated via user prompts at user interface 42. Information about pump 6 can also be input in a similar manner to relate pump speed or number of cycles to pumped volume so that motor speed can be translated to volume over time values, and vice versa.

The motor parameter set in step 68 can be motor speed. In an embodiment in which motor 14 is a fixed speed motor, controller 10 can, using pump 6 information, calculate an output flow rate based on the fixed speed of motor 14 and the flow rate of pump 6 at that motor speed. More specifically, output flow rate of pump 6 can be equal to: [motor speed]×[a conversion factor of motor speed to pump cycle rate]×[volume output per pump cycle].

The motor parameter can also be a motor duty cycle. The motor duty cycle can correspond to the motor 14 "on" time within each duty cycle period (i.e., the total "on" and "off" time per cycle) to achieve the desired total flow rate in each duty cycle period. The duty cycle period can be, for example, ten seconds, one minute, 24 hours, or some other duration. The motor duty cycle can be calculated to deliver the desired total flow rate in each duty cycle period, based on the conversion from motor speed to volume rate of pump 6 output. If a high total flow rate is needed to supply wells 40, then a correspondingly high duty cycle of motor 14 can be set, calculated to deliver the desired total flow rate in each duty cycle period of motor 14. For example, a high duty cycle can correspond to longer "on" time such that motor 14 operates for 50 minutes of a one-hour duty cycle period to complete the delivery of the desired total flow rate for the period. Motor 14 would then remain off (i.e., a dwell period) for the final ten minutes. If a relatively lower total flow rate is needed to supply wells 40, then a correspondingly low duty cycle of motor 14 can be set. For example, motor 14 may operate for only ten minutes of each one-hour duty cycle period to achieve the desired total flow rate.

In an embodiment in which motor 14 is a variable speed motor, controller 10 can be configured to assume that motor 14 will run to operate pump 6 at all times, such that there is no duty cycle for motor 14. Instead, the speed of motor 14 can be calculated based on the constant speed needed to achieve the desired total flow rate. For example, a high speed can be calculated for a correspondingly high flow rate, and a relatively low speed can be calculated for a correspondingly low total flow rate.

Method 60 further includes setting valve duty cycles for each electric valve 32 at step 70. Step 70 can include scheduling the valve duty cycles such that each electric valve 32 is opened in sequential order to correspond with operation of motor 14 to drive pump 6, during which only one electric valve 32 is open to at any one time to permit flow of the chemical solution therethrough. The remaining electric valves 32 are closed such that no chemical solution is permitted to flow therethrough. The valve duty cycles can accordingly be set such that only one electric valve 32 is open when motor 14 is operating pump 6, and also such that pump 6 is not operated when no electric valve 32 is scheduled to be open.

In an embodiment with a fixed speed motor 14, step 68 further involves scheduling the valve duty cycles such that each electric valve 32 is open for a period of time proportional to the flow rate set for a respective well 40 based on the total flow rate calculated at step 66. For example, if the flow rate for a single well 40 is set to be one-eighth the total flow rate, then the valve duty cycle for the respective electric valve 32 corresponding to that single well 40 will correspondingly be one-eighth the motor duty cycle. The total of the individual valve duty cycles can therefore be equal to the motor duty cycle. As such, motor 14 will stop operating with the closure of the final electric valve 32 in the scheduled sequence and will shut off during the dwell period of the motor duty cycle period. With the start of the subsequent motor duty cycle period, motor 14 restarts to operate pump 6, and electric valves 32 are signaled to begin the next valve duty cycle.

As discussed above, there may be no motor duty cycle for a variable speed motor 14, because motor 14 will run constantly to operate pump 6 at all times. In such an embodiment, the duty cycle of electric valves 32 can be set such that one, but only one, electric valve 32 is provided with an open command by the controller at a given time to avoid operation of pump 6 when all electric valves 32 are closed. A total of the individual valve duty cycles can be, for example, ten seconds, one minute, 24 hours, or some other duration. During a valve duty cycle period, each valve 32 opens and closes once, and the valve duty cycle for each valve 32 can be proportional to the flow rate for the respective well 40 based on the desired total flow rate. For example, if the flow rate for a single well 40 is set to be one-eighth the total flow rate, then the duty cycle for the respective electric valve 32 can be one-eighth the total of the individual valve duty cycle period.

After all required duty cycles (for motor 14 and/or electric valves 32) are set, method 60 proceeds to step 72 at which motor 14 and electric valves 32 are operated by controller 10 according to the set schedule.

Method 60 can optionally include step 74 for determining a failure of any electric valve 32. Electric valves 32 are configured such that electrical energy is required to overcome a spring force to open (or remain open), so a failure of an electric valve 32 causes it to close and remain closed, not permitting fluid to flow therethrough. Operating in such a fail-safe manner prevents over-delivery of chemical solution to any one of wells 40 in the event of a failure of the respective electric valve 32. Further, the closure of a failed electric valve 32 allows the remaining operable electric valves 32 to open as scheduled such that the respective wells 40 continue to receive chemical solution. Without the fail-safe configuration (i.e., closure of a failed electric valve 32), failed electric valve 32 could fail in the open state and prevent the remaining electric valves 32 from opening, because only one electric valve 32 can be open at a given time.

One embodiment includes valve failure detection based on current of motor 14. The closure of a failed electric valve 32 results in a dead-head condition in which pressure downstream of pump 6 spikes because the chemical solution cannot flow through a failed electric valve 32 causing pump 6 to strain. This leads to increased current draw through motor 14. Controller 10 can monitor current draw through motor 14 and can detect a current spike based on any of absolute current value, RMS current, rise in current, or exceeding a threshold value associated with a dead-head condition. Controller 10 can determine that an electric valve 32 has failed based on the increased current draw.

Additionally or alternatively, failure of an electric valve 32 can be detected based on a rise in pressure. As discussed above, closure of failed electric valve 32 can lead to a dead-head condition that causes a pressure spike downstream of pump 6. Pressure sensor 29 (e.g., a pressure transducer) can be located along the flow path somewhere downstream of outlet 24 of pump 6 (e.g., proximate and downstream of inlet 44 of manifold 8) and can output pressure information to controller 10. An increase in pressure relative to a threshold level, or an expected or average pressure can indicate a failure in an electric valve 32 scheduled to be open when the pressure increase is detected.

As was previously discussed, motor 14 only runs to operate pump 6 when an electric valve 32 is scheduled to be open. As such, controller 10 can determine the specific failed electric valve 32 based on which electric valve is supposed to be but is not open according to the valve duty cycle schedule. In some examples, controller 10 can generate an alert regarding the failed electric valve 32 and can provide that alert to the user, such as via interface 42, among other options. After controller 10 determines which electric valve 32 has failed, method 60 can return to step 66 and controller 10 recalculates a new total flow rate that excludes the well 40 associated with failed electric valve 32, as that well 40 can no longer receive chemical solution due to the failed electric valve 32. From step 66, method 60 again proceeds to steps 68 and 70 to set new motor and valve duty cycles, respectively, based on the recalculated total flow rate.

A duty cycle or speed of motor 14 can be adjusted correspond with the recalculated total flow rate. For a fixed speed motor 14, the new motor duty cycle can be reduced compared to the previous motor duty cycle such that motor 14 runs for a shorter duration for each duty cycle period. The duty cycle for each remaining (i.e., non-failed) electric valve 32 can remain the same but can be shifted to account for the reduced motor duty cycle and the absence of the failed electric valve 32 in the schedule. For a variable speed motor 14, motor 14 can be set to a lower speed due to the reduced total flow rate. The "open" period for each remaining (i.e., non-failed) electric valve 32 will be increased because one electric valve 32 must always be open, but there is one fewer electric valve 32 in the schedule.

Discussion of Non-Exclusive Embodiments

The following are non-exclusive descriptions of possible embodiments of the present invention.

A fluid handling system suitable for injecting a pressurized fluid from a pump that is driven by a motor into an oilfield network includes a manifold fluidly connected to the pump and a controller. The manifold includes an inlet for receiving the fluid from the pump, a plurality of outlets downstream of and fluidly connected to the inlet, and a plurality of electric valves downstream of and fluidly connected, respectively, to the plurality of outlets, each of the plurality of electric valves being configured to selectively open and close to regulate a flow of the fluid from the plurality of outlets to a plurality of wells fluidly connected, respectively, to the plurality of electric valves. The controller is configured to receive a plurality of flow rate values of the plurality of wells, determine a plurality of duty cycles for the plurality of electric valves based on the plurality of flow rate values, and determine a schedule for the plurality of duty cycles so that only one of the plurality of electric valves is controlled open at a given time.

The system of the preceding paragraph can optionally include, additionally and/or alternatively, any one or more of the following features, configurations and/or additional components:

In the above system, the controller can be configured to receive information about the configuration of the motor as one of a fixed speed motor and a variable speed motor.

In any of the above systems, for a fixed speed motor, the controller can determine an output flow rate of the pump based on a fixed speed of the motor and a flow rate of the pump at the fixed speed.

In any of the above systems, the controller can determine the plurality of duty cycles by aggregating the plurality of flow rate values to determine a total flow rate, and subsequently calculating each of the plurality of duty cycles of each of the plurality of electric valves as being proportional to one flow rate value of the plurality of flow rate values as compared to the total flow rate.

In any of the above systems, the schedule for the plurality of duty cycles can correspond to a motor duty cycle such that when the motor is running to drive the pump, only one of the plurality of electric valves is open, and none of the plurality of electric valves are open during a dwell period of the motor.

In any of the above systems, the controller can be configured to determine the schedule such that the motor runs continuously while the plurality of duty cycles are executed.

In any of the above systems, the controller can be configured to detect a failed one of the plurality of electric valves based on an increase of a parameter, the parameter being one of motor current and fluid pressure downstream of an outlet of the pump.

A fluid handling system suitable for injecting a pressurized fluid from a pump that is driven by a motor into an oilfield network includes a manifold fluidly connected to the pump and a controller. The manifold includes an inlet for receiving the fluid from the pump, a plurality of outlets downstream of and fluidly connected to the inlet, and a plurality of electric valves downstream of and fluidly connected, respectively, to the plurality of outlets, each of the plurality of electric valves being configured to selectively open and close to regulate a flow of the fluid from the plurality of outlets to a plurality of wells fluidly connected, respectively, to the plurality of electric valves. The controller is configured to receive a plurality of flow rate values of the plurality of wells, determine a plurality of duty cycles for the plurality of electric valves based on the plurality of flow rate values, determine a schedule for the plurality of duty cycles so that only one of the plurality of electric valves is controlled open at a given time, and detect a failed one of the plurality of electric valves based on an increase of a parameter.

The system of the preceding paragraph can optionally include, additionally and/or alternatively, any one or more of the following features, configurations and/or additional components:

In the above system, the parameter can be motor current.

In any of the above systems, the parameter can be fluid pressure downstream of an outlet of the pump, and a pressure sensor can detect and output fluid pressure information.

In any of the above systems, the controller can be configured to, based on detection of the failed one of the plurality of electric valves, recalculate the plurality of duty cycles for the plurality of electric valves and reset a schedule for the plurality of duty cycles which excludes the failed one of the plurality of electric valves.

In any of the above systems, the schedule can include a motor duty cycle.

In any of the above systems, the controller can be configured to, based on detection of the failed one of the plurality of electric valves, adjust the motor duty cycle such that the motor duty cycle is shorter in duration after recalculation.

In any of the above systems, the controller can be configured to, based on detection of the failed one of the plurality of electric valves, adjust the motor speed such that the motor speed is lower after recalculation.

In any of the above systems, the failed one of the plurality of electric valves can fail to a closed position.

A manifold for use in a fluid handling system suitable for injecting a pressurized fluid from a pump that is driven by a motor into an oilfield network includes a manifold block having an inlet for receiving the fluid from the pump, a plurality of outlets downstream of and fluidly connected to the inlet, and a plurality of electric valves downstream of and fluidly connected, respectively, to the plurality of outlets.

The manifold of the preceding paragraph can optionally include, additionally and/or alternatively, any one or more of the following features, configurations and/or additional components:

In the above manifold, each of the plurality of electric valves can be removably connected to the manifold block via a respective connector such that each of the plurality of electric valves is independently removable from the manifold block.

Any of the above manifolds can further include a plurality of electrical conduits connected to an electrical junction housing positioned vertically above the manifold block, the plurality of electrical conduits extending downward to connect, respectively, to the plurality of electric valves, and a plurality of electrical cables disposed, respectively, within the plurality of electrical conduits and extending from the electrical junction housing to the plurality of electric valves to electrically connect the plurality of electric valves to the electrical junction housing.

In any of the above manifolds, each of the plurality of electrical cables can be disconnected from the electrical junction housing and pulled downward through a respective one of the plurality of electrical conduits upon disconnection of a respective one of the plurality of electric valves from the manifold block.

In any of the above manifolds, each of the plurality of electric valves can include an electronic actuator positioned vertically above a fluid handling portion of each of the plurality of electric valves.

In any of the above manifolds, the plurality of electric can include at least three electric valves.

In any of the above manifolds, the electrical junction housing can include a first electrical junction housing and a second electrical junction housing, and the plurality of electric valves can include eight electric valves.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A fluid handling system suitable for injecting a pressurized fluid from a pump that is driven by a motor into an oilfield network, the system comprising:

a manifold fluidly connected to the pump, the manifold comprising:

an inlet for receiving the pressurized fluid from the pump;

a plurality of outlets downstream of and fluidly connected to the inlet; and a plurality of electric valves downstream of and fluidly connected, respectively, to the plurality of outlets, each of the plurality of electric valves configured to selectively open and close to regulate a flow of the pressurized fluid from the plurality of outlets to a plurality of wells fluidly connected, respectively, to the plurality of electric valves; and a controller configured to:

receive a plurality of flow rate values of the plurality of wells;

determine a plurality of duty cycles for the plurality of electric valves based on the plurality of flow rate values; and determine a schedule for the plurality of duty cycles so that only one of the plurality of electric valves is controlled open at a given time;

wherein the controller determines the plurality of duty cycles by aggregating the plurality of flow rate values to determine a total flow rate, and subsequently calculating each of the plurality of duty cycles of each of the plurality of electric valves as being proportional to one flow rate value of the plurality of flow rate values as compared to the total flow rate.

2. The system of claim 1, wherein the controller is configured to receive information about the configuration of the motor as one of a fixed speed motor and a variable speed motor.

3. The system of claim 1, wherein the schedule for the plurality of duty cycles corresponds to a motor duty cycle such that when the motor is running to drive the pump, only one of the plurality of electric valves is open, and none of the plurality of electric valves are open during a dwell period of the motor.

4. The system of claim 3, wherein the controller is configured to determine the schedule such that the motor runs continuously while the plurality of duty cycles are executed.

5. The system of claim 1, wherein the controller is configured to detect a failed one of the plurality of electric valves based on an increase of a parameter, the parameter being one of motor current and fluid pressure downstream of an outlet of the pump.

6. A fluid handling system suitable for injecting a pressurized fluid from a pump that is driven by a motor into an oilfield network, the system comprising:

a pump having a motor;

a manifold fluidly connected to the pump, the manifold comprising:

an inlet for receiving the pressurized fluid from the pump;

a plurality of outlets downstream of and fluidly connected to the inlet; and a plurality of electric valves downstream of and fluidly connected, respectively, to the plurality of outlets, each of the plurality of electric valves configured to selectively open and close to regulate a flow of the pressurized fluid from the plurality of outlets to a plurality of wells fluidly connected, respectively, to the plurality of electric valves; and a controller configured to:

receive a plurality of flow rate values of the plurality of wells;

determine a plurality of duty cycles for the plurality of electric valves based on the plurality of flow rate values;

determine a schedule for the plurality of duty cycles so that only one of the plurality of electric valves is controlled open at a given time; and detect a failed one of the plurality of electric valves based on an increase of a parameter;

wherein the controller determines the plurality of duty cycles by aggregating the plurality of flow rate values to determine a total flow rate, and subsequently calculating each of the plurality of duty cycles of each of the plurality of electric valves as being proportional to one flow rate value of the plurality of flow rate values as compared to the total flow rate.

7. The system of claim 6, wherein the parameter is motor current.

8. The system of claim 6, wherein the parameter is fluid pressure downstream of an outlet of the pump, and wherein a pressure sensor detects and outputs fluid pressure information.

9. The system of claim 8, wherein the controller is configured to, based on detection of the failed one of the plurality of electric valves, recalculate the plurality of duty cycles for the plurality of electric valves and reset a schedule for the plurality of duty cycles which excludes the failed one of the plurality of electric valves.

10. The system of claim 9, wherein the schedule includes a motor duty cycle.

11. The system of claim 10, wherein the controller is configured to, based on detection of the failed one of the plurality of electric valves, adjust the motor duty cycle such that the motor duty cycle is shorter in duration after recalculation.

12. The system of claim 6, wherein the failed one of the plurality of electric valves fails to a closed position.

13. A manifold for use in a fluid handling system suitable for injecting a pressurized fluid from a pump that is driven by a motor into an oilfield network, the manifold comprising:

a manifold block having an inlet for receiving the pressurized fluid from the pump;

a plurality of outlets downstream of and fluidly connected to the inlet;

a plurality of electric valves downstream of and fluidly connected, respectively, to the plurality of outlets;

a plurality of electrical conduits connected to an electrical junction housing positioned vertically above the manifold block, the plurality of electrical conduits extending downward to connect, respectively, to the plurality of electric valves; and a plurality of electrical cables disposed, respectively, within the plurality of electrical conduits and extending from the electrical junction housing to the plurality of electric valves to electrically connect the plurality of electric valves to the electrical junction housing.

14. The manifold of claim 13, wherein each of the plurality of electric valves is removably connected to the manifold block via a respective connector such that each of the plurality of electric valves is independently removable from the manifold block.

15. The manifold of claim 13, wherein each of the plurality of electrical cables can be disconnected from the electrical junction housing and pulled downward through a respective one of the plurality of electrical conduits upon disconnection of a respective one of the plurality of electric valves from the manifold block.

16. The manifold of claim 15, wherein each of the plurality of electric valves comprises an electronic actuator positioned vertically above a fluid handling portion of each of the plurality of electric valves.

17. The manifold of claim 16, wherein the plurality of electric valves comprises at least three electric valves.

18. The manifold of claim 13, wherein the electrical junction housing comprises a first electrical junction housing and a second electrical junction housing, and wherein the plurality of electric valves comprises eight electric valves.

19. A fluid handling system suitable for injecting a pressurized fluid from a pump that is driven by a motor into an oilfield network, the system comprising:

a manifold fluidly connected to the pump, the manifold comprising:

an inlet for receiving the pressurized fluid from the pump;

a plurality of outlets downstream of and fluidly connected to the inlet; and a plurality of electric valves downstream of and fluidly connected, respectively, to the plurality of outlets, each of the plurality of electric valves configured to selectively open and close to regulate a flow of the pressurized fluid from the plurality of outlets to a plurality of wells fluidly connected, respectively, to the plurality of electric valves; and a controller configured to:

receive a plurality of flow rate values of the plurality of wells;

determine a plurality of duty cycles for the plurality of electric valves based on the plurality of flow rate values;

determine a schedule for the plurality of duty cycles so that only one of the plurality of electric valves is controlled open at a given time; and detect a failed one of the plurality of electric valves based on an increase of a parameter;

wherein the parameter is fluid pressure downstream of an outlet of the pump;

wherein a pressure sensor detects and outputs fluid pressure information; and wherein the controller is configured to, based on detection of the failed one of the plurality of electric valves, recalculate the plurality of duty cycles for the plurality of electric valves and reset a schedule for the plurality of duty cycles which excludes the failed one of the plurality of electric valves.

* * * * *